US007192111B2

(12) United States Patent
Matsumoto et al.

(10) Patent No.: US 7,192,111 B2
(45) Date of Patent: Mar. 20, 2007

(54) INK TANK WITH INDUCTANCE-BASED RESIDUE DETECTION AND RECORDING APPARATUS USING THE SAME

(75) Inventors: Ryoichi Matsumoto, Tokyo (JP); Ryoji Inoue, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 10/944,720

(22) Filed: Sep. 21, 2004

(65) Prior Publication Data

US 2005/0068349 A1 Mar. 31, 2005

(30) Foreign Application Priority Data

Sep. 29, 2003 (JP) ..... 2003-338724

(51) Int. Cl.
*B41J 2/195* (2006.01)
*B41J 2/17* (2006.01)
*B41J 2/175* (2006.01)

(52) U.S. Cl. ..... 347/7; 347/84; 347/86

(58) Field of Classification Search ..... 347/84, 347/7, 86
See application file for complete search history.

(56) References Cited

U.S. PATENT DOCUMENTS 4,165,641 A * 8/1979 Pomerantz et al. ..... 73/290 R
6,164,743 A * 12/2000 Hmelar et al. ..... 347/7
6,685,296 B2 2/2004 Mochizuki et al. ..... 347/19
6,719,394 B2 4/2004 Kubota et al. ..... 347/19
6,773,099 B2 8/2004 Inoue et al. ..... 347/86
6,827,411 B2 12/2004 Kubota et al. ..... 347/7
2003/0035036 A1 2/2003 Ogura et al. ..... 347/86
2003/0067518 A1 4/2003 Ishinaga et al. ..... 347/85
2004/0061748 A1 4/2004 Kuwabara et al. ..... 347/85
2004/0090510 A1 5/2004 Inoue et al. ..... 347/104
2004/0135854 A1 7/2004 Kuwabara et al. ..... 347/85

FOREIGN PATENT DOCUMENTS

JP 7-125251 5/1995
JP 10-217508 8/1998

* cited by examiner

*Primary Examiner*—Hai Pham
*Assistant Examiner*—Carlos A. Martinez, Jr.
(74) *Attorney, Agent, or Firm*—Fitzpatrick, Cella, Harper & Scinto

(57) ABSTRACT

An ink tank includes a coil, and the coil is in contact with ink in the ink tank so that inductance is changed according to the amount of ink remaining in the ink tank. The coil is connected to a recording apparatus through electric contacts.

8 Claims, 9 Drawing Sheets

INK TANK WITH INDUCTANCE-BASED RESIDUE DETECTION AND RECORDING APPARATUS USING THE SAME

BACKGROUND OF THE INVENTION

1. Field of the Invention

The present invention relates to an ink tank and a recording apparatus which can detect the amount of ink remaining.

2. Related Background Art

For example, the recording apparatus in which an image is recorded with liquid ink can be cited as an example of the recording apparatus using liquid. An ink jet recording apparatus, in which the image is recorded on a recording medium by using an ink jet recording head which can discharge the liquid ink to provide the ink onto the recording medium, can be cited as an example of the recording apparatus in which an image is recorded with liquid ink. In the ink jet recording apparatus, noise is relatively small during the recording and small dots can be formed in high density, so that the ink jet recording apparatus is currently utilized in many recording applications including color recording. In one of forms of the ink jet recording apparatus, there is the type of ink jet recording apparatus using the ink jet recording head to which an ink tank is integrally or separably attached. The ink jet recording apparatus using the ink jet recording head to which the ink tank is integrally or separably attached includes a carriage on which the ink jet recording head is mounted and which causes the ink jet recording head to relatively scan in a predetermined direction relative to the recording medium (main scan) and conveying means for conveying relatively the recording medium in the direction (sub-scan) orthogonal to the direction in which the ink jet recording head is scanned. In the main scan of the ink jet recording head, the ink is discharged from the ink jet recording head to perform the recording. The ink jet recording apparatus also includes one in which not only monochrome recording for a text image can be performed only with black ink, but also full color recording can be performed by mounting the recording head in which both the black ink and color ink (yellow, cyan, magenta, and the like) can be discharged to change a rate of discharge of each color ink.

In the use of the ink jet recording apparatus, it is necessary to grasp the amount of ink remaining in the ink tank.

In the ink jet recording apparatus, detection of the amount of ink remaining can prevent recording failure caused by the absence of the ink and waste of the recording paper incident to the recording failure. When the ink jet recording head including means for generating thermal energy such as an electrothermal transducer is used as means for discharging the ink, the ink is discharged by utilizing pressure generated by a change in state of the ink to which the thermal energy is given. In the ink jet recording apparatus adopting the electrothermal method, the detection of the amount of ink remaining can encourage a user to change the ink tank in order to prevent breakage of the ink jet recording head of itself caused by temperature rise of the ink jet recording head when the thermal energy generating means is driven while the ink is absent. For example, the amount of ink remaining can be displayed by detecting the amount of ink remaining in the ink tank, an alarm can be issued in the case of the small amount of ink remaining, and the recording operation can be stopped with these notifications.

Conventionally, the configuration which uses an optical element to detect a permeable state of the ink tank changed according to the amount of ink remaining, and the configuration which detects an electrically conductive state changed according to a liquid level of the ink by using a plurality of electrode members arranged inside the ink tank (hereinafter these are referred to as sensor type) can be cited as an example of the configuration for detecting that the ink is used up in the ink tank (ink end). The configuration, in which the number of discharge pulses for discharging the ink from the ink jet recording head is counted to determine the amount of used ink and the amount of ink remaining is estimated based on the amount of used ink (hereinafter referred to as dot count type), is well known as another method of detecting the amount of ink remaining.

The ink volume detecting method disclosed in Japanese Patent Application Laid-Open (JP-A) No. H07-125251 can be cited as still another example. In the method of JP-A No. H07-125251, an ink liquid chamber including a diaphragm and a core which shift according to the amount of ink remaining is provided in an ink channel which supplies the ink in the ink tank to the ink jet recording head, and the amount of ink remaining is detected by changing a position of the core in a coil outside the ink channel.

In the ink volume detecting method disclosed in JP-A No. H10-217508, the coil is wound around the outside of the ink channel which supplies the ink from the ink tank to the ink jet recording head or at least a part of the ink tank, and the amount of ink remaining is detected from inductance of the coil changed by the amount of ink inside the coil.

In the sensor type using the optical element or the electrode member, it is necessary to add the number of components in order to detect the amount of ink remaining in stages, which causes a problem that production cost is increased. Further, it is necessary to secure a space for arranging the component such as the optical element, so that it is difficult to detect the amount of ink remaining in multi stages, and usually the liquid level of the ink is detected only in the ink end.

In the dot count type counting the number of discharge pulses of the ink, because the amount of ink remaining is estimated while variations in the amount of ink used in forming the dot are included, when the amount of ink remaining is detected at any point from the state in which the ink tank is filled with the ink to the state in which the ink is used up, there is the problem that error of the amount of ink remaining is absolutely caused to hardly detect the correct ink end point.

In the case of the type of JP-A No. H07-125251, since the ink liquid chamber is enlarged, there is the problem that the ink liquid chamber can not be integrated with the carriage which is formed so that the small ink tank is detachably mounted. Particularly, when the plurality of ink tanks is provided for the color recording, since the ink liquid chamber is provided corresponding to each color ink tank, there is the problem that the ink jet recording apparatus is upsized and the cost is increased.

For the method of winding the coil around the ink channel in the case of the type of JP-A No. H10-217508, since the amount of ink remaining can not be detected in stages, the liquid level of the ink is detected only in the ink end. In the method of winding the coil around the ink tank, the amount of ink remaining can be linearly detected to a certain extent. However, since the ink is arranged only inside the coil, in the ink except for magnetic ink disclosed in JP-A H10-217508, there is the problem that magnetic fluxes are largely decreased near the coil and the change in inductance is decreased to worsen the detection accuracy.

As described above, in the sensor type, there is the problem that the number of components is increased and the space is difficult to secure in order to detect the amount of ink remaining in stages. In the dot count type, there is the problem that the error is generated in the amount of ink remaining. In the method of winding the coil around the ink tank as described in JP-A No. 10-217508, when the ink except for the magnetic ink is used, there is the problem that the change in inductance of the coil changed by the ink volume inside the ink tank is decreased.

SUMMARY OF THE INVENTION

It is an object of the invention to provide the ink tank and the recording apparatus which can accurately detect the amount of ink remaining in the ink tank with simple configuration.

Another object of the invention is to provide the ink tank and the recording apparatus which can detect the amount of ink remaining of various kinds of ink except for the magnetic ink.

An ink tank of the invention which supplies ink to a recording head used for a recording apparatus, the ink tank comprises a coil whose outside is formed in a coil shape by a conductor coated with an insulator, the coil coming into contact with the ink in the ink tank so that inductance is changed according to the mount of ink remaining of the ink tank and connecting means for connecting directly or indirectly the coil to the recording apparatus.

A recording apparatus of the invention which performs recording by using a recording head to which ink is supplied from the ink tank of the invention, the recording apparatus comprises a connection portion electrically connected to the connecting means of the ink tank and detecting means for detecting the amount of ink remaining in the ink tank based on inductance of the coil connected through the connection portion and the connecting means of the ink tank.

According to the invention, the amount of ink remaining in the ink tank can be accurately detected with the very simple configuration by using the coil which is in contact with the ink in the ink tank so that the inductance is changed according to the mount of ink remaining in the ink tank. The amount of ink remaining of various kinds of ink except for the magnetic ink can be detected.

DETAILED DESCRIPTION OF THE PREFERRED EMBODIMENTS

Referring to the accompanying drawings, preferred embodiments of the invention will be described below.

(First Embodiment)

Figure 6:
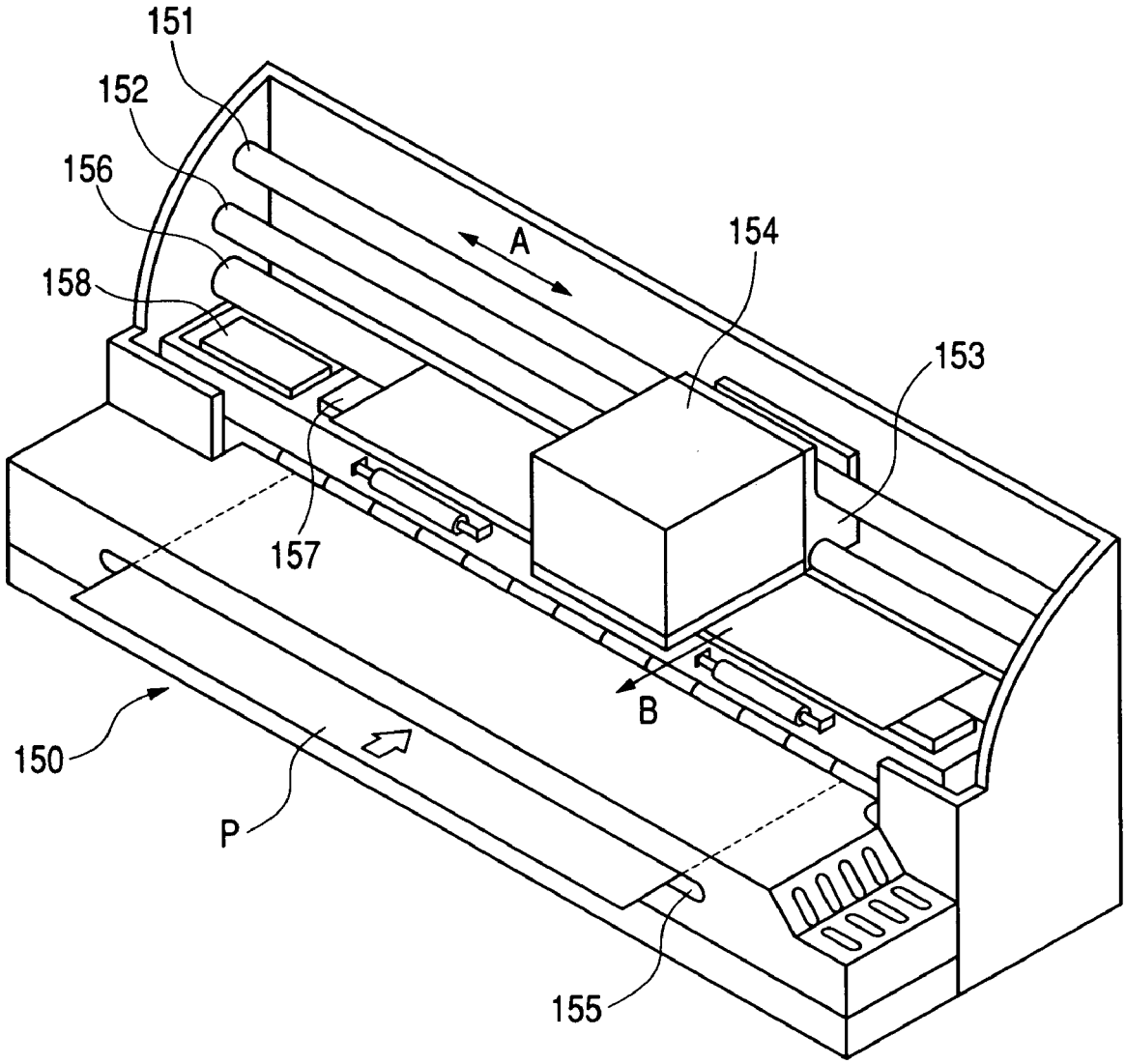
FIG. 6 is a perspective view showing a configuration example of an ink jet recording apparatus to which the invention can be applied.

FIG. 6 is a perspective view showing a configuration example of the ink jet recording apparatus to which the invention can be applied. A recording apparatus 150 is the serial scan type of ink jet recording apparatus. A carriage 153 is guided by guide shafts 151 and 152 while the carriage can be freely moved in a main scanning direction of an arrow A. The carriage 153 reciprocates in the main scanning direction by a carriage motor and a drive force transmission mechanism which transmits drive force of the carriage motor. A liquid supply system 154 is mounted on the carriage 153. The liquid supply system 154 includes a recording head/supply portion and the ink tank which is attached to the recording head/supply portion to supply the ink. After paper P which is of the recording medium is inserted from a feed port 155 provided at a front end portion of the apparatus, a conveying direction of the paper P is reversed, and a feed roller 156 conveys the paper P in a sub-scanning direction of an arrow B. While the recording apparatus 150 moves the recording head in the main scanning direction, the recording apparatus 150 records an image on the paper P by repeating a recording operation in which the ink is discharged toward a recording area of the paper P on a platen 157 and a conveying operation in which the paper P is conveyed in the sub-scanning direction by a distance corresponding to a recording width.

It is possible that the recording head utilizes thermal energy generated from an electrothermal transducer as the energy for discharging the ink. In this case, film boiling is caused to be generated by heat generation of the electrothermal transducer in the ink, and the ink can be discharged from a nozzle by bubble forming energy in the film boiling. In the recording head, the method of discharging the ink is not limited to the method in which the electrothermal transducer is used. For example, it is possible to adopt the method in which the ink is discharged by using a piezoelectric element.

A recovery unit (recovery process means) 158 is provided at the left end of the moving area of the carriage 153. The recovery unit 158 is arranged opposite to an ink nozzle surface of the recording head mounted on the carriage 153. The recovery unit 158 includes a cap which can cap the ink nozzles of the recording head and a suction pump which can introduce negative pressure into the cap. The ink is sucked and drained from the ink nozzles by introducing the negative pressure in the cap which caps the ink nozzles and thereby the recovery process of maintaining the recording head at good ink discharge state can be performed. Aside from the image formation, the recovery process of maintaining the recording head at good ink discharge state can be also performed by discharging the ink from the ink nozzles toward the cap (also referred to as pre-discharge process).

In the ink jet recording apparatus having the above-described configuration, it is necessary to grasp the amount of ink remaining in the ink tank to perform properly the change of ink tanks.

Figure 1:
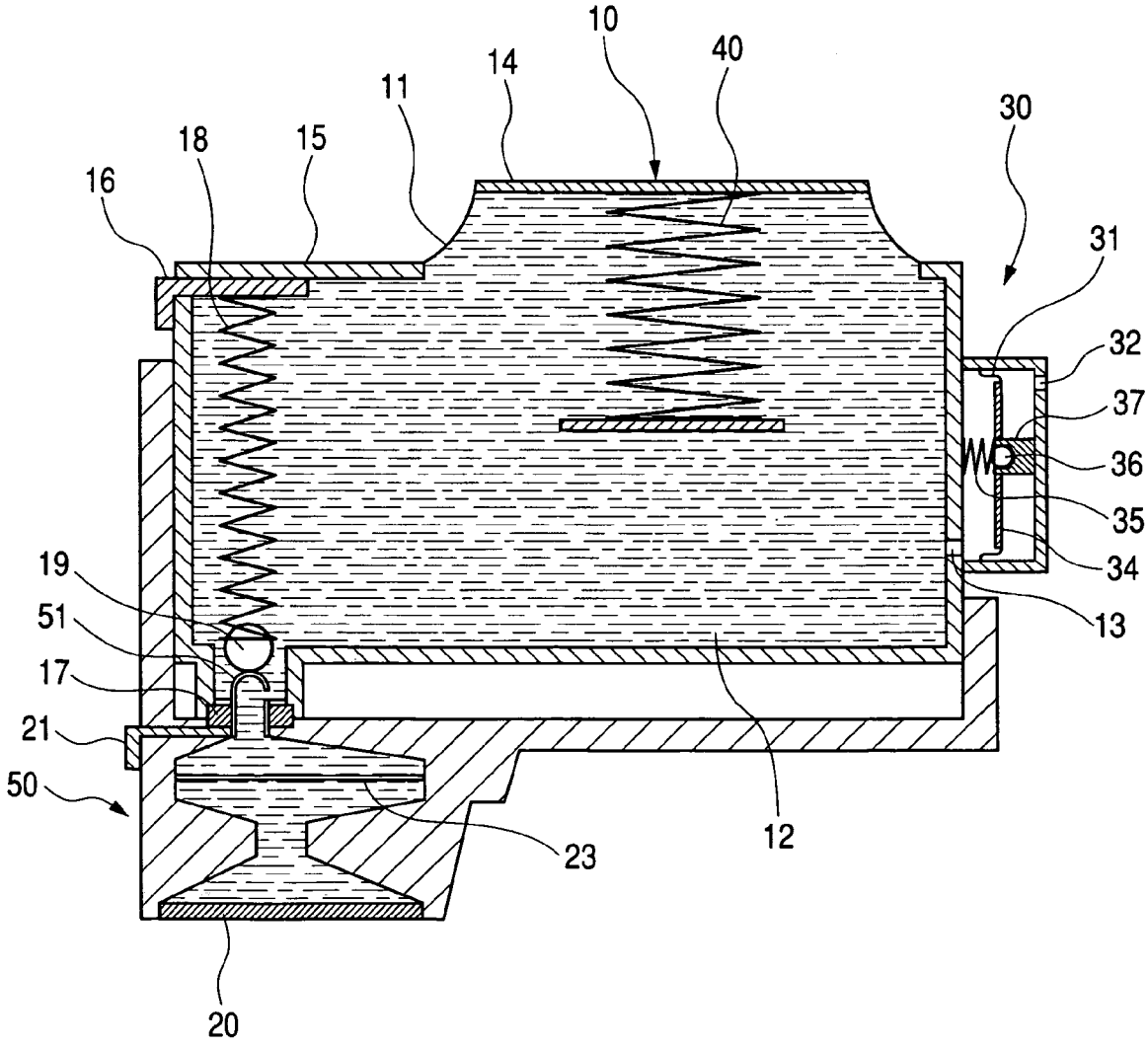
FIG. 1 is a sectional view showing a main part in a first embodiment of the invention.

FIG. 1 is a sectional view for explaining the schematic configuration of the liquid supply system 154. The liquid supply system 154 includes an ink tank 10, an ink jet recording head (hereinafter simply referred to as recording head) 20, and a supply portion 50 which forms an ink supply channel communicating the ink tank 10 and the recording head 20. The ink tank 10 is formed so as to be separable from the recording head 20 and the supply portion 50. It is also possible that the ink tank 10 is integrated with the recording head 20 or the supply portion 50. It is also possible that the supply portion 50 is separable from or integral with the recording head 20. It is also possible that the supply portion 50 is provided in the carriage 153 mounting on which the recording head 20 is mounted to form the ink supply channel from the ink tank 10 to the recording head 20 when the ink tank is mounted from the upper portion. The reference numeral 23 represents a filter.

The ink tank 10 includes two chambers of an ink containing chamber 12 which defines an ink containing space and a valve chamber 30. The insides of the ink containing chamber 12 and the valve chamber 30 are communicated with each other through a communicating channel 13. The ink which is discharged from the recording head 20 is contained in the ink containing chamber 12, and the ink is supplied to the recording head 20 according to an ink discharging operation.

A flexible film (sheet member) 11 is arranged in a part of the ink containing chamber 12. The sheet member 11 and an inflexible external packaging 15 define the ink containing space. The external space opposite from the ink containing space, i.e. the upper side space of the sheet member 11 in FIG. 1 is equal to atmospheric pressure. The ink containing space actually forms the sealed space except for the connection portion to the supply portion 50 provided in the lower portion and the communicating channel 13 to the valve chamber 30.

In the central portion of the sheet member 11 of the embodiment, the shape is defined by a pressure plate 14 which is of a plate-shaped support member. A peripheral portion thereof is deformable. The central portion of the sheet member 11 is previously formed in the convex shape, and the side face shape of the sheet member is formed in a substantial trapezoid. As described later, the sheet member 11 is deformed according to the change in the amount of ink or pressure fluctuation in the ink containing space. At this point, peripheral portions of the sheet member 11 is expandably and compressibly deformed while kept in balance, and the central portion of the sheet member 11 is vertically moved while substantially keeping a horizontal attitude. Therefore, since the sheet member 11 is smoothly deformed (moved), impact incident to the deformation of the sheet member 11 is not generated, and the abnormal pressure fluctuation caused by the impact is not generated in the ink containing space.

A spring member 40 having a compression spring form, which biases the sheet member 11 upward through the pressure plate 14, is provided in the ink containing space. The negative pressure in a range where the ink discharge operation can be performed in the recording head is generated by reaching equilibrium between the action of the spring member 40 and holding force of an ink meniscus formed in the ink discharge portion of the recording head 20. FIG. 1 shows the state in which the ink containing space is substantially completely filled with the ink. Even in this state, the spring member 40 is compressed, and the appropriate negative pressure is generated in the ink containing space.

A one-way valve is formed in the valve chamber 30. The one-way valve prevents ink leakage from the ink tank 10, and gas (air) is introduced from the outside through the one-way valve when the negative pressure in the ink containing space is decreased beyond a predetermined value. The one-way valve includes a pressure plate 34, a sealing member 37, and a seat member 31. The pressure plate 34 has a communicating port 36 and becomes a valve closing member. The sealing member 37 is fixed to an inner wall of a housing of the valve chamber 30 so as to oppose to the communicating port 36, and the sealing member 37 can seal the communicating port 36. The seat member 31 is connected to the pressure plate 34, and the communicating port 36 pierces through the seat member 31. The sealed space is substantially maintained in the valve chamber 30 except for the communicating port 13 to the ink tank 10 and the communicating port 36. The space in the housing of the valve chamber 30 located on the right side of the sheet member 31 is opened into atmosphere by an atmosphere communicating port 32 to be equal to the atmospheric pressure.

In the sheet member 31, the peripheral portions can be deformed, the central portion except connected to the pressure plate 34 is formed in the convex shape, and the side face shape is formed in the substantial trapezoid. The pressure plate 34 which is of the valve closing member is smoothly moved in the horizontal direction of FIG. 1 by the above-described configuration.

In the valve chamber 30, a spring member 35 is provided as a valve control member for controlling an opening operation of the one-way valve. The spring member 35 is slightly compressed, and the pressure plate 34 is pressed rightward by reaction force of the compression. The close contact/separation can be performed between communicating port 36 and the sealing member 37 by the expansion and compression of the spring member 35. Therefore, the valve chamber 30 acts as the valve. The valve chamber 30 also acts as the one-way valve which permits the gas to be introduced into the valve chamber from the atmosphere communicating port 32 through the communicating port 36.

The sealing member 37 is not limited to the embodiment, and any sealing member can be used as long as the sealing member securely seals the communicating port 36. The sealing member 37 whose region in contact with at least the communicating port 36 has the shape holding flatness relative to an opening surface of the communicating port 36, the sealing member having a rib which can come into close contact with the periphery of the communicating port 36, the sealing member which can have a front end entering the communicating port 36 to close the communicating port 36, and the like can be used as the sealing member 37 of the embodiment as long as the sealing member securely seals the communicating port 36. The material of the sealing member 37 is not particularly limited. Since the close contact can be achieved by elongation force of the spring member 35, it is preferable that the sealing member 37 is formed by the material which easily follows the seat member 31 and the pressure plate 34 moved by the action of the elongation force, i.e. the elastic material such as rubber having shrink characteristics.

In the ink tank 10, the ink in the ink containing chamber 12 is gradually decreased by the consuming the ink from the initial state in which the ink containing chamber 12 is sufficiently filled with the ink. When the ink is further consumed from the state in which the equilibrium is reached in negative pressure in the ink containing chamber 12 and the force caused by the valve control member (spring member 35) in the valve chamber 30, at the moment when the negative pressure is further increased in the ink containing chamber 12, the communicating port 36 is opened and the atmosphere flows into the ink containing chamber 12. The sheet member 11 and the pressure plate 14 are shifted upward by the in-flow of the atmosphere to increase a volume of the ink containing chamber 12, and the negative pressure is simultaneously weakened to close the communicating port 36 again.

Even if the change in environment of the ink tank 10, e.g. temperature rise or the decrease in pressure is generated, the expansion of the air taken in the ink containing chamber 12 is permitted to the extent of the change in volume in the ink containing chamber 12 corresponding to the amount of shift from the lowest position of the pressure plate 14 to the initial position shown in FIG. 1. Namely, the space corresponding to the change in volume acts as a buffer area, the increase in pressure in the ink containing chamber 12 which is caused by the change in environment is eased, and the ink leakage from the nozzle of the recording head 20 can effectively prevented.

In supplying the ink from the initially filled state (FIG. 1) of the ink tank 10, the outside air is not introduced into the ink containing chamber 12 until the volume of the internal volume of the ink containing chamber 12 is decreased to secure the buffer area, so that the ink leakage is not generated even if the rapid change in environment, vibration, or drop of the ink tank 10 occurs. Further, since the buffer area is not previously secured in the ink containing chamber 12 from the beginning, ink volume efficiency of the ink tank 10 is high, and the ink tank 10 can be formed in a compact size.

Although the spring member 40 in the ink containing chamber 12 and the spring member 35 in the valve chamber 30 are schematically formed in the shape of the coil spring in FIG. 1, the spring member having other shape can be also used. For example, a conical spring or a plate spring can be also used as the spring member of the invention. In the case of the use of the plate spring, it is possible that the pair of substantially U-shaped plate spring members is formed and the pair of plate spring members is opposed to each other to combine open ends of the plate spring members.

The recording head 20 and the ink tank 10 are connected to each other by inserting a connection portion 51 of the supply portion 50 into the ink tank 10. The connection portion 51 is integrally provided in the recording head 20. Therefore, the recording head 20 and the ink tank 10 are fluidically coupled, which allows the ink to be supplied from the ink tank 10 to the recording head 20.

Figure 2:
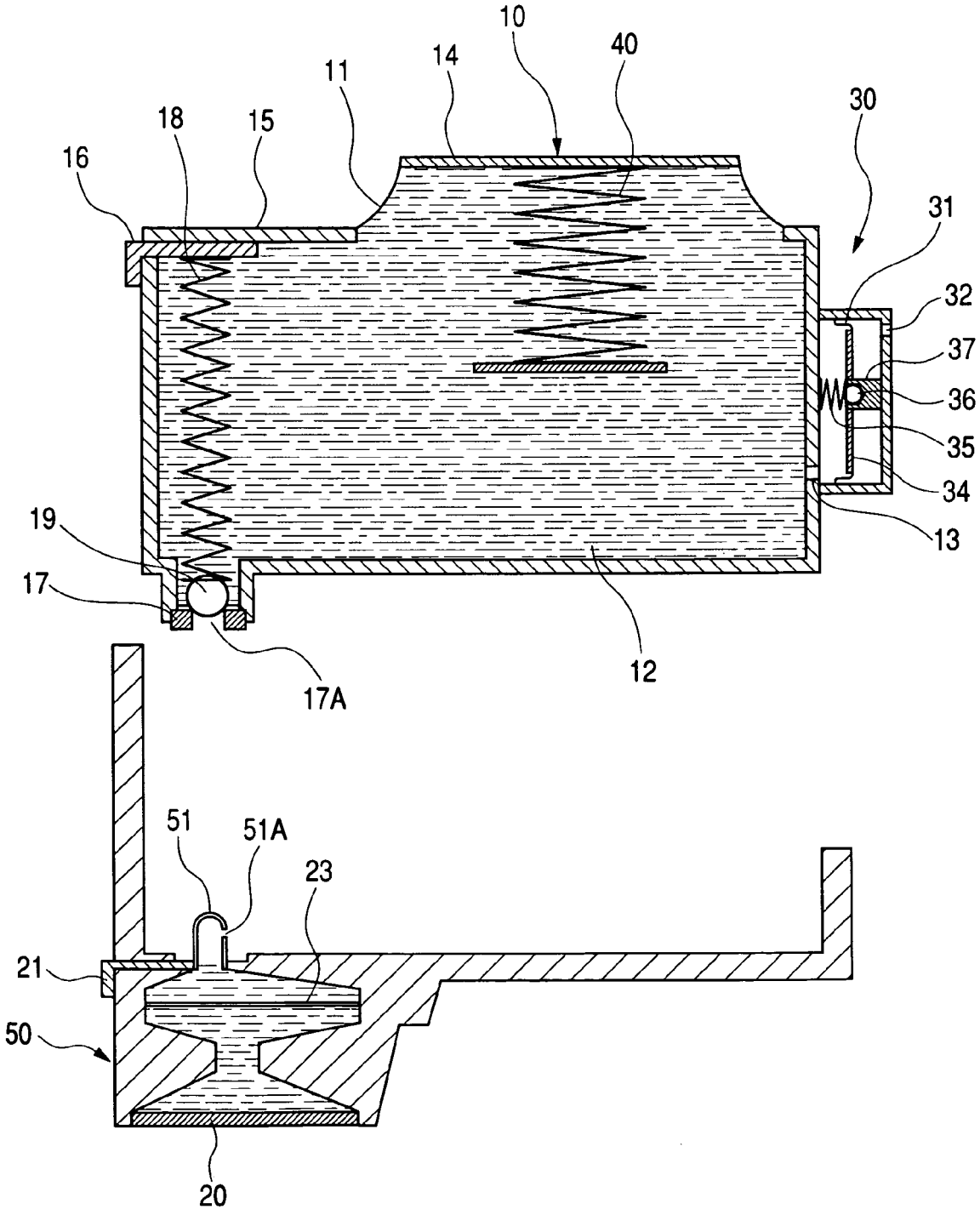
FIG. 2 is a sectional view in the state in which an ink tank and a supply portion on the recording head side of FIG. 1 are separated from each other.

FIG. 2 is an explanatory view showing the state before the connection portion 51 of the supply portion 50 is inserted into the ink tank 10. A sealing member 17 made of rubber or the like is attached to an opening on the side of the ink tank 10 into which the connection portion 51 is inserted. The sealing member 17 secures the connection between the connection portion 51 and the ink tank 10 while coming into close contact with the periphery of the connection portion 51 to prevent the ink leakage from the ink tank 10. A hole 17A for inserting the connection portion 51 is made in the sealing member 17. When the connection portion 51 is not inserted, a joint ball 19 closes the hole 17A by elastic force of a coil-shaped joint spring 18 to prevent the ink leakage from the ink tank 10.

In the joint spring 18, for example, the inside is made of a conductor such as metal, and a coating film of an insulator such as resin is formed on the outside. The joint spring 18 is arranged at a position dipped in the ink in the ink tank 10. When the ink tank 10 is held at the attitude (attitude in which the vertical direction of FIG. 1 is set to the vertical direction of the ink tank 10) in which the ink can be used, the longitudinal direction of the joint spring 18 is set so as to become the direction in which a liquid level of the ink is changed in the ink tank 10. In all the case where the amount of ink remaining in the ink tank 10 is changed, the joint spring 18 intersects the liquid level of the ink in the longitudinal direction. Since the joint spring 18 is dipped in the ink, it is desirable that the coating film made of insulator does not contain the material eluted into the ink as impurities. For example, it is desirable that the coating film is made of polypropylene or polyethylene which has an extremely low additive. At one end (upper end) of the joint spring 18, the inner conductor is connected to an electric contact 16 on the side of the ink tank 10. The electric contact 16 pierces through the ink tank wall 15, and the end portion located outside the ink tank 10 is electrically connected to the side of the ink jet recording apparatus. The other end (lower end) of the joint spring 18 presses the joint ball 19 against the sealing member 17 as described above. In the other end of the joint spring 18, the insulating coating film is removed at the contact surface between joint spring 18 and the joint ball 19, the exposed conductor of the joint spring 18 is electrically connected to the joint ball 19 which is of the conductive member. When the ink tank 10 is coupled to the supply portion 50 as shown in FIG. 1, the joint ball 19 is electrically connected to an electric contact 21 on the side of the supply portion 50. Namely, the electric contact 21 is electrically connected to the connection portion 51 that is the conductor. When the connection portion 51 of the supply portion 50 is inserted into the ink tank 10 as shown in FIG. 1, the connection portion 51 pushes up the joint ball 19 against the elastic force of the joint spring 18, which allows the joint ball 19 to be electrically connected to the electric contact 21 through the connection portion 51. The electric contact 21 can be electrically connected to the connection portion on the side of the ink jet recording apparatus.

Therefore, when the ink tank 10 and the supply portion 50 are coupled to each other as shown in FIG. 1, the electric contact 16, the joint spring 18, the joint ball 19, the connection portion 51, and the electric contact 21 are electrically connected to one another to form a coil L which is a part of the later-mentioned electric circuit. Further, when the ink tank 10 and the supply portion 50 are coupled to each other as shown in FIG. 1, the ink supply channel is formed from the inside of the ink tank to the recording head 20 through a hole 51A of the connection portion 51 (see FIG. 2).

Figure 3:
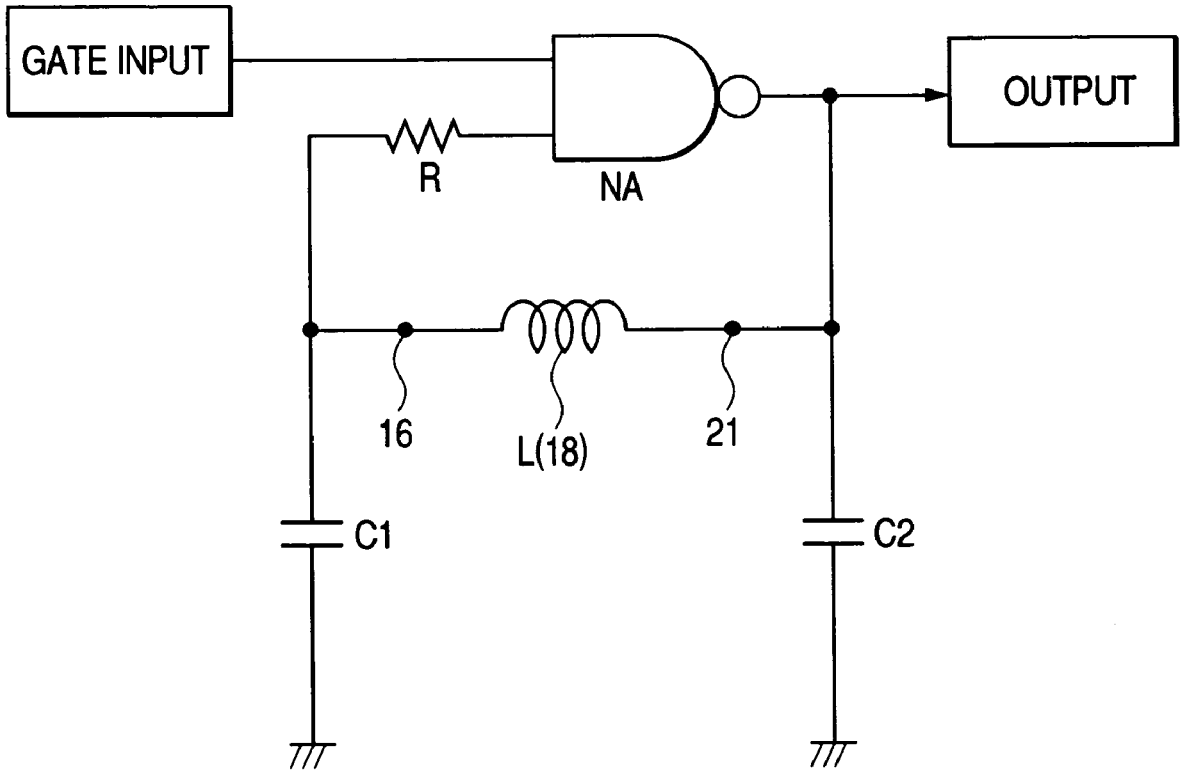
FIG. 3 is a circuit diagram showing an oscillation control circuit connected to a coil of FIG. 1.

FIG. 3 is an explanatory view showing an example of the basic configuration of the electric circuit on the side of the ink jet recording apparatus to which the electric contacts 16 and 21 are connected.

The joint spring 18 acts as a coil (inductance) L having a core of the ink in the ink tank 10, and the inductance is changed according to a length of the joint spring 18 dipped in the ink, i.e. according to the amount of ink remaining in the ink tank. Since the coil 18 is dipped in the ink while the ink exists inside and outside the coil 18, the inductance becomes larger when compared with the case where the ink exists only inside the coil 18. Therefore, as mentioned below, the change in inductance corresponding to the amount of ink remaining becomes larger, and the amount of ink remaining can be securely detected. An oscillation control circuit includes a NAND gate NA, a resistor R, and capacitors C1 and C2. In the oscillation control circuit, an oscillation frequency is changed according to the inductance of the coil L. The NAND gate NA acts as an inverter when "H" is input to a gate input. At this point, the oscillation control circuit of FIG. 3 oscillates at the frequency according to the inductance of the coil L. When "L" is input to the gate input of the NAND gate NA, the oscillation control circuit of FIG. 3 does not act.

Figure 4:
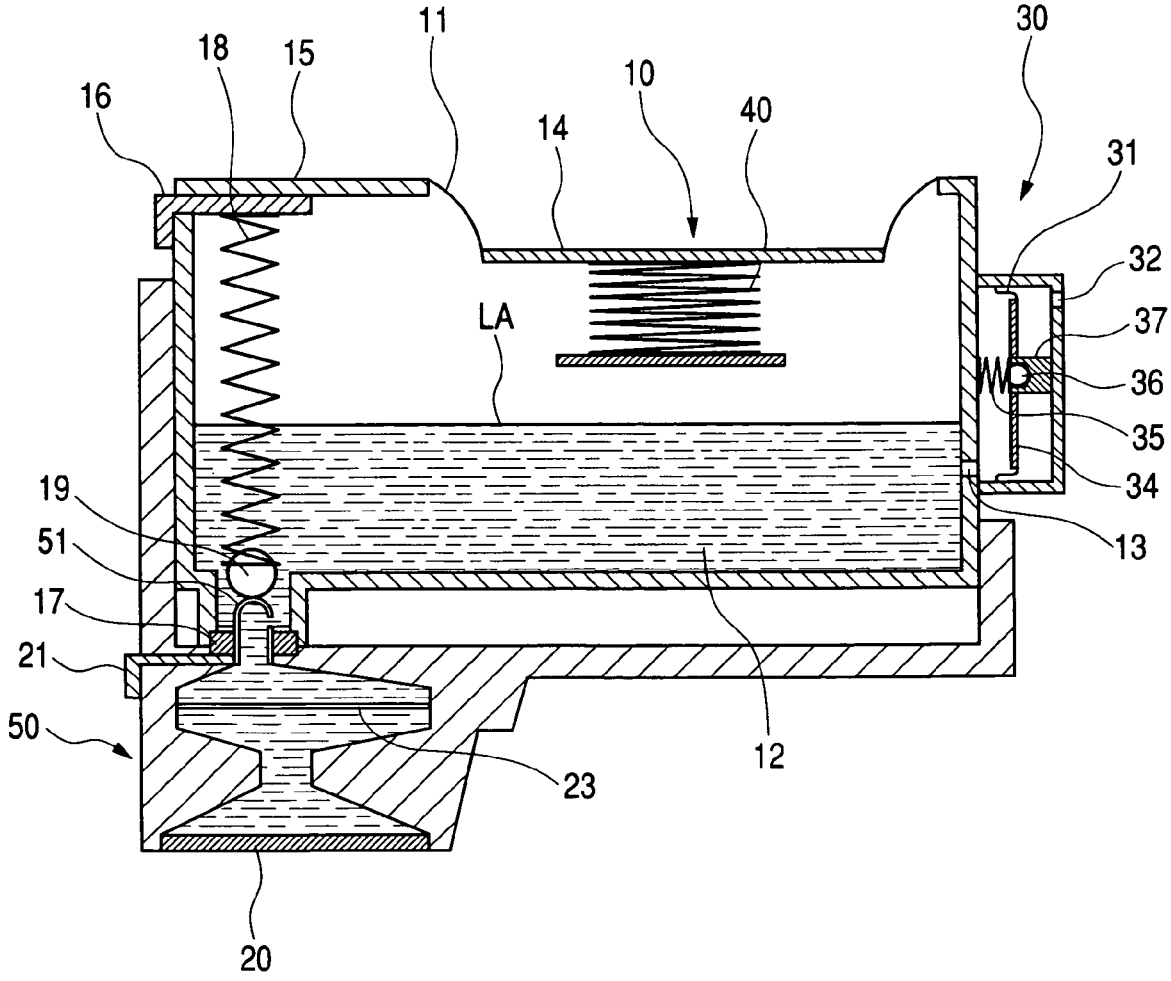
FIG. 4 is a sectional view for explaining the state in which ink is used in the ink tank of FIG. 1.

FIG. 4 is a sectional view showing the state in which the ink in the ink tank 10 is consumed by the ink discharge and the recovery process from the recording head 20. As the ink is consumed by the recording head 20, the ink in the ink tank 10 is moved to the supply portion 50 through the connection portion 51. Thereby, the inner volume of the ink containing chamber 12 is decreased and the sheet member 11 is deformed toward the lower portion of the ink tank 10 while controlled by the pressure plate 14. Accordingly, the spring member 40 is compressed and the negative pressure in the ink containing chamber 12 is also increased. As described above, when the ink is further consumed from the state in which the equilibrium is reached in negative pressure in the ink containing chamber 12 and the force caused by the valve control member (spring member 35) in the valve chamber 30, at the moment when the negative pressure is further increased in the ink containing chamber 12, the communicating port 36 is opened and the atmosphere flows into the ink containing chamber 12. The sheet member 11 and the pressure plate 14 are shifted upward by the in-flow of the atmosphere to increase a volume of the ink containing chamber 12, and the negative pressure in the ink containing chamber 12 is simultaneously weakened to close the communicating port 36 again.

Figure 5:
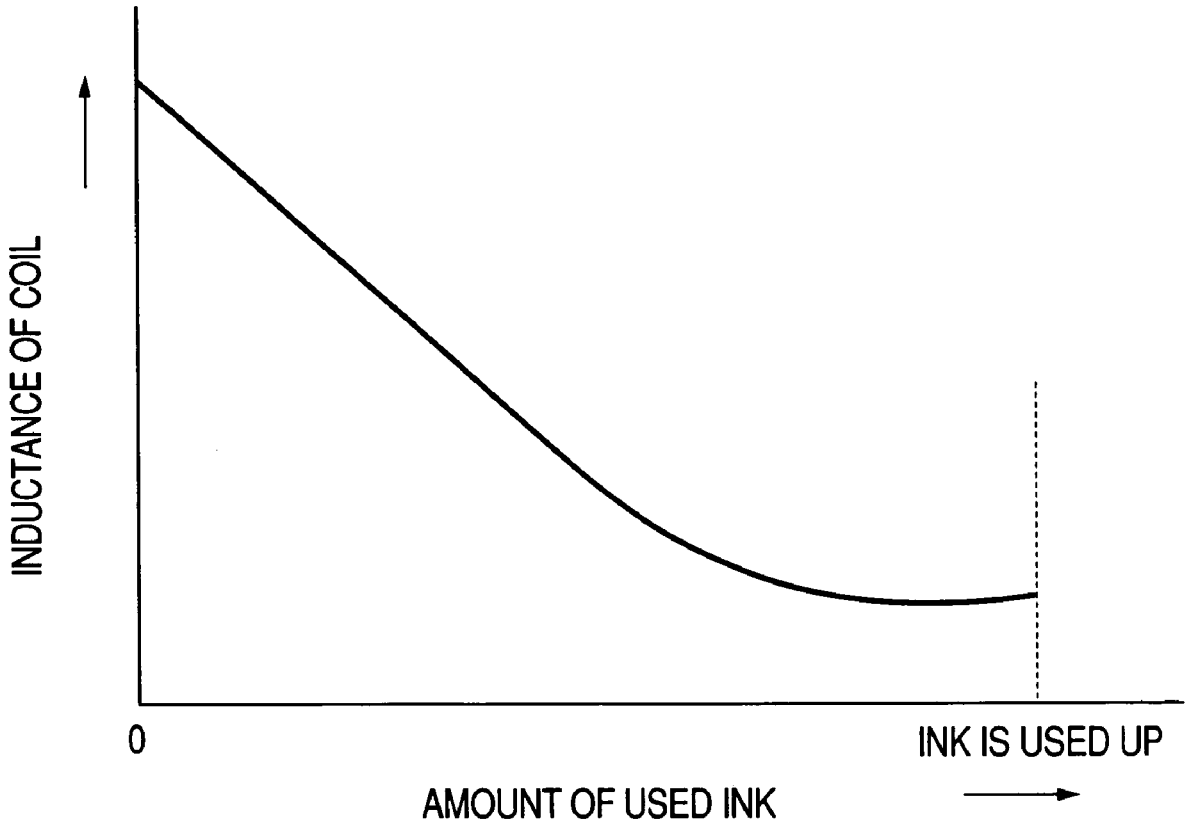
FIG. 5 is an explanatory view showing a relationship between inductance of the coil of FIG. 1 and the amount of used ink.

As the ink is consumed in the ink tank 10, an ink liquid level LA is lowered to decrease the length of the coil L (18) dipped in the ink in the ink tank 10, which allows the inductance of the coil L to be decreased. FIG. 5 shows a relationship between the amount of used ink and the inductance of the coil L. The ink jet recording apparatus uses the oscillation control circuit shown in FIG. 3 to detect the change in the inductance of the coil L as the change in frequency of the pulse. This allows the amount of ink remaining to be detected in the ink tank 10.

Figure 9:
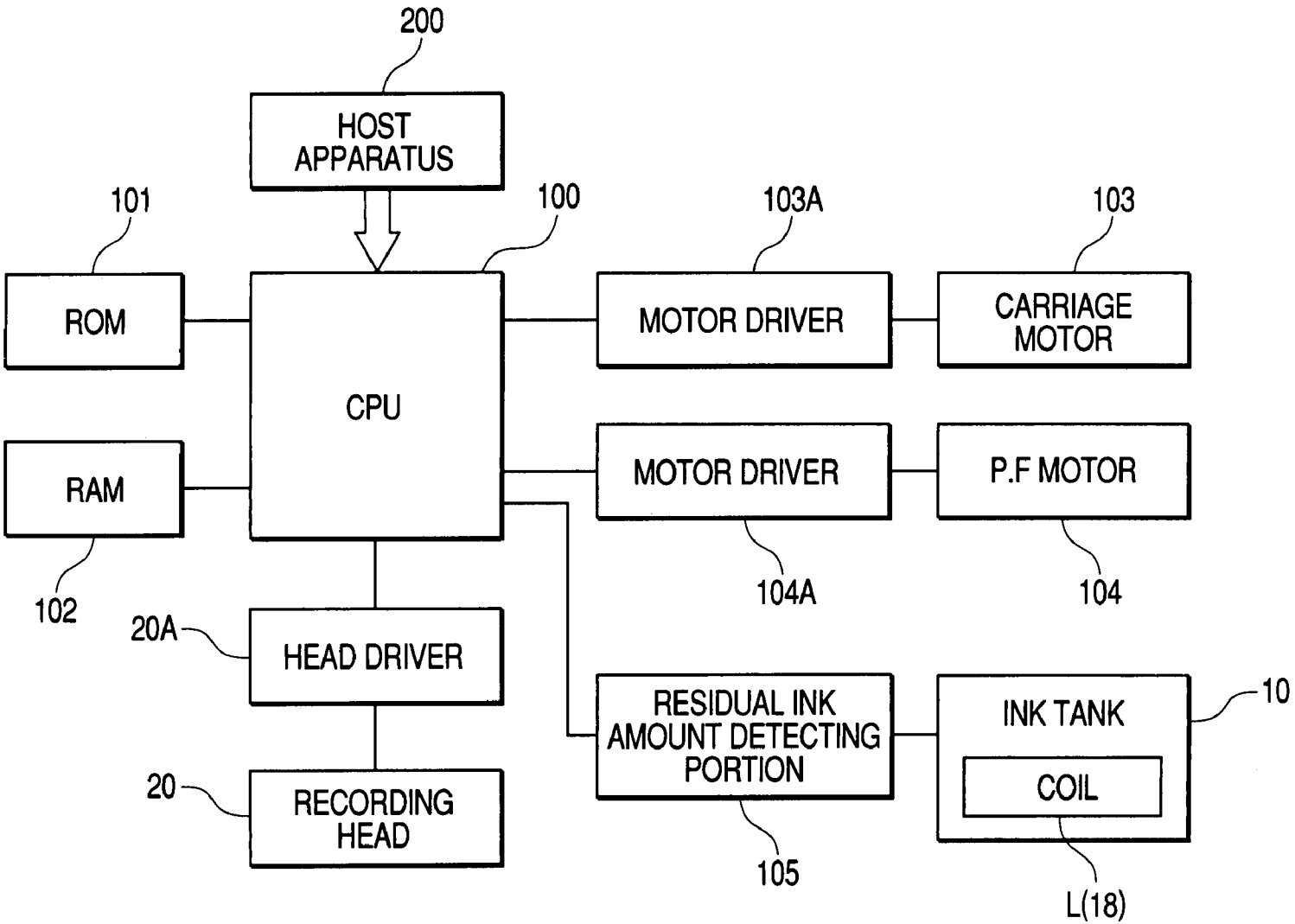
FIG. 9 is a block diagram showing a control system of the ink jet recording apparatus in the first embodiment of the invention.

FIG. 9 is a schematic block diagram showing a control system of the ink jet recording apparatus. In FIG. 9, CPU 100 executes control processing of the operation and data processing of the ink jet recording apparatus. The programs of these processing procedures are stored in a ROM 101, and a RAM 102 is used as a work area for executing the processing. The ink is discharged from the recording head 20 by providing drive data (image data) and drive control signals (heat pulse signals) of the electrothermal transducer (heater) in the recording head 20 from CPU 100 to a head driver 20A. CPU 100 controls a carriage motor 103 for driving the carriage 153 in the main scanning direction through a motor driver 103A. CPU 100 also controls a PF motor 104 for conveying the paper P in the sub-scanning direction through a motor driver 104A.

The reference numeral 105 represents a residual ink amount detecting portion 105 having the circuit configuration shown in FIG. 3. The residual ink amount detecting portion 105 is connected to the coil L (18) in the ink tank 10 to detect the amount of ink remaining in the ink tank 10 based on the inductance of the coil L. CPU 100 performs display or issues an alarm for encouraging a user to change the ink tank 10. In the embodiment, the coil L is connected to the residual ink amount detecting portion 105 through the electric contact 10 on the side of the ink tank 10 and the electric contact 21 on the side of the recording head 20. Therefore, the ink tank 10 and the recording head 20 are coupled to each other and the ink tank 10 and the recording head 20 are attached to the ink jet recording apparatus, which allows the connection circuit of the coil L to be formed. As a result, the attachment state of the ink tank 10 and the recording head 20 can be detected in the residual ink amount detecting portion 105.

(Second Embodiment)

Figure 7:
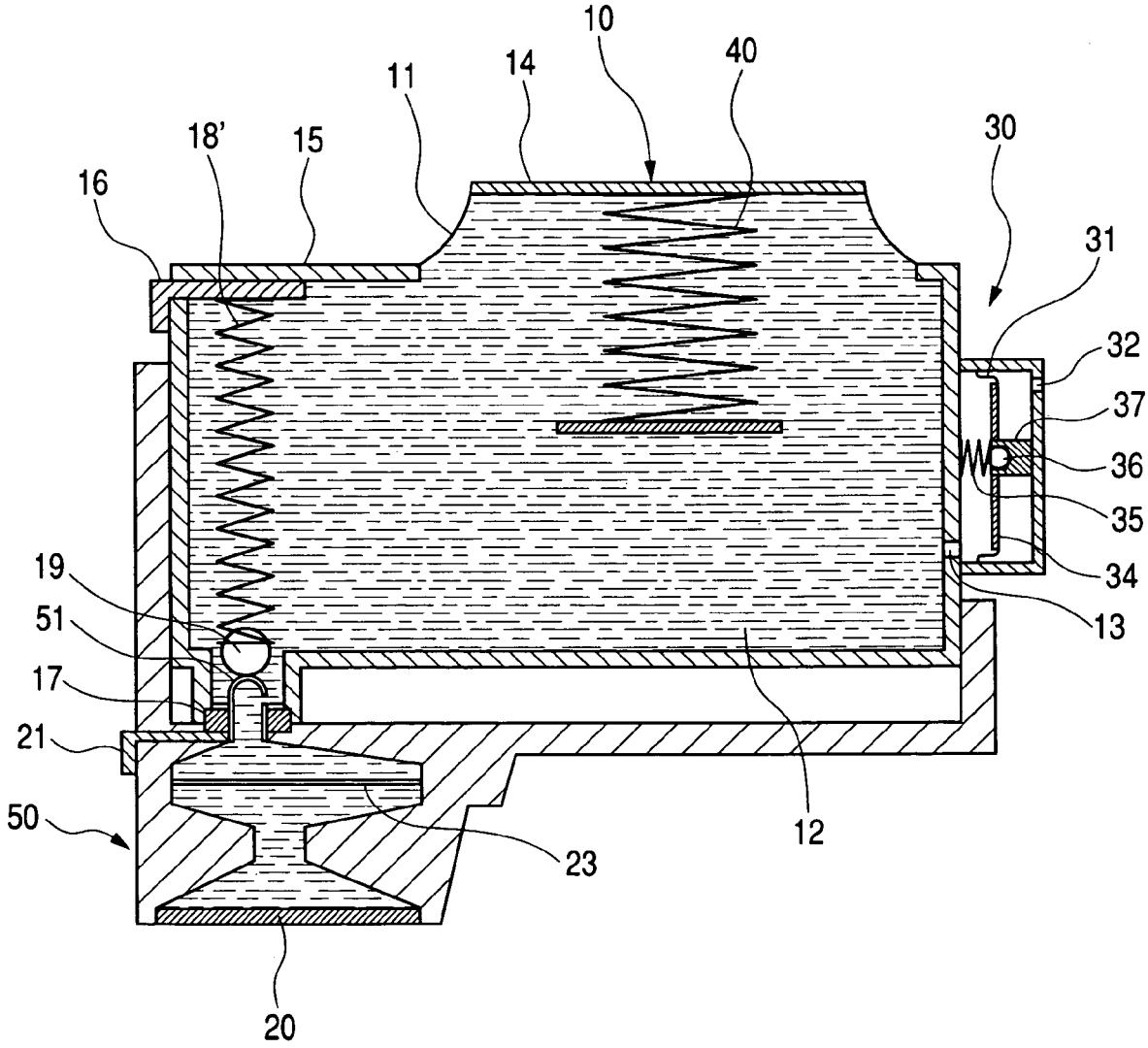
FIG. 7 is a sectional view of the main part in a second embodiment of the invention.

FIG. 7 is a sectional view of the main part in a second embodiment of the invention.

Figure 8:
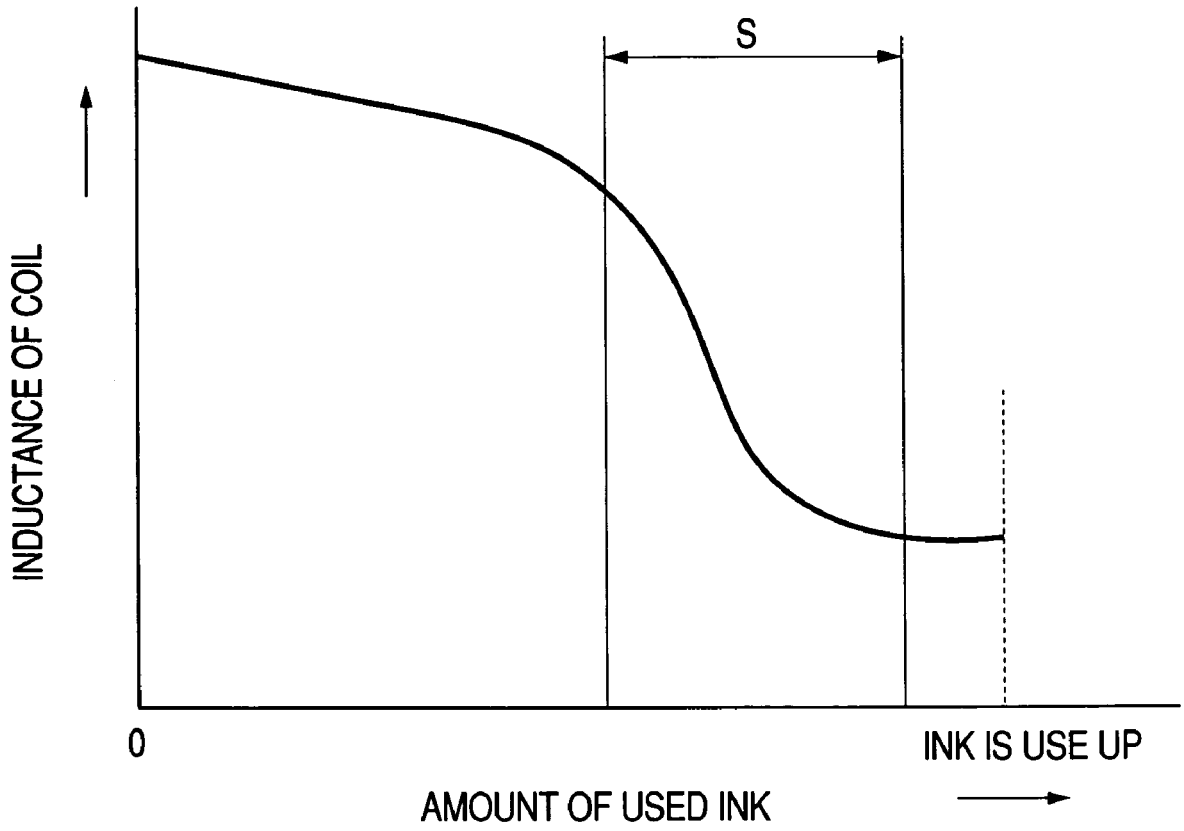
FIG. 8 is an explanatory view showing the relationship between the inductance of the coil of FIG. 8 and the amount of used ink.

In the second embodiment, a joint spring 18' acting as the coil L is changed at a middle point along the longitudinal direction in the winding diameter. When the winding diameter on the lower side of the joint spring 18' is larger than that of the upper side as shown in FIG. 7, the inductance of the coil L (18') is changed as shown in FIG. 8 according to the amount of used ink (the amount of consumption). In a range S in which the liquid level of the link is being lowered in the lower portion of the joint spring 18' having the larger winding diameter, a rate of change of the inductance of the coil L is increased to the change in fall of the liquid level of the ink (the amount of used ink). Therefore, that the liquid level of the ink gets close to the point (ink end) at which the ink is used up in the ink tank 10 can be more certainly detected. Thus, detection accuracy is improved when the residual ink alarm is issued in stages. It is also possible that the winding diameter of the joint spring 18' is changed in at least three stages, which allows the detection sensitivity of the amount of ink remaining to be set to at least three stages.

(Another Embodiment)

It is possible that the joint spring 18 is arranged to come into contact with the ink in the ink tank 10 at least in a detection range of the amount of ink remaining in the ink tank 10. It is not always necessary that the longitudinal direction of the joint spring 18 is the vertical direction, and it is possible that the joint spring 18 is arranged slightly obliquely due to the arrangement space. It is essential that the inductance of the joint spring 18 is changed according to the amount of ink remaining in the ink tank 10. In addition to the joint spring 18 for biasing the joint ball 19 (the member which seals the ink supply portion of the ink tank 10 for supplying the ink to the recording head 20), the springs having various functions can be used as the coil L in the ink tank 10. It is also possible that the ink tank 10 includes the coil which acts only as the coil L.

It is possible that the coil L is connected to the recording apparatus only through the electric contact on the side of the ink tank 10, or it is possible that the coil L is connected to the recording apparatus only through the electric contact on the side of the recording head 20. It is essential that the coil L on the side of the ink tank 10 can be directly or indirectly connected to the recording apparatus. Further, it is also possible that the ink tank 10 and the recording head 20 form the integral ink jet cartridge.

The method of detecting the inductance of the coil L is not limited to the method in which the inductance is detected as the change in oscillation frequency as described above. It is essential that the method of electrically detecting the inductance of the coil L is used. Further, it is also possible that at least a part of the circuit for detecting the inductance of the coil L is arranged on the side of the inductance 10.

In addition to the so-called serial scan type recording apparatus as described above, the invention can be widely applied to the so-called full line type recording apparatus which uses a continuous recording head. Further, the invention can be also applied to the detection of the amount of remaining of various liquids (chemicals, drinking water, and the like) except for the ink.

This application claims priority from Japanese Patent Application No. 2003-338724 filed on Sep. 29, 2003, which is hereby incorporated by reference herein.

What is claimed is:

1. An ink tank which supplies ink to a recording head used for a recording apparatus, the ink tank comprising:

a coil whose outside is formed in a coil shape by a conductor coated with an insulator, the coil coming into contact with the ink in the ink tank so that inductance is changed according to the amount of ink remaining of the ink tank;

connecting means for connecting directly or indirectly the coil to the recording apparatus;

a supply port which supplies the ink to the recording head, sealing member which seals the supply port, and a spring which biases the sealing member toward a sealing direction of the supply port, wherein the coil also has a function as the spring.

2. An ink tank according to claim 1, wherein the connecting means connects the coil to the recording apparatus through the sealing member.

3. An ink tank according to claim 1, wherein the connecting means connects the coil to the recording apparatus through the sealing member and the recording head.

4. An ink tank according to claim 1, wherein the sealing member has a core located inside the coil.

5. An ink tank according to claim 1, wherein a winding diameter is changed in the coil.

6. An ink tank according to claim 1, wherein a longitudinal direction of the coil is located along a substantially vertical direction in an attitude in which the ink tank is used.

7. A recording apparatus which performs recording by using a recording head to which ink is supplied from an ink tank according to any one of claims 1 or 2 to 6, the recording apparatus comprising:

a connection portion which is electrically connected to the connecting means of the ink tank; and detecting means for detecting the amount of ink remaining in the ink tank based on inductance of the coil connected through the connection portion and the connecting means of the ink tank.

8. A recording apparatus according to claim 7, wherein the detecting means includes an oscillation control circuit in which an oscillation frequency is changed according to the inductance of the coil.

* * * * *